United States Patent [19]

Gauna

[11] Patent Number: 4,954,018

[45] Date of Patent: Sep. 4, 1990

[54] YIELD TUBE BOLT ASSEMBLY

[75] Inventor: Michael Gauna, Tuscaloosa, Ala.

[73] Assignee: Jim Walter Resources, Inc., Birmingham, Ala.

[21] Appl. No.: 6,304

[22] Filed: Jan. 15, 1987

Related U.S. Application Data

[63] Continuation of Ser. No. 741,995, Jun. 6, 1985, abandoned.

[51] Int. Cl.[5] ..... E21D 21/00

[52] U.S. Cl. ..... 405/259; 405/262; 411/10; 411/8

[58] Field of Search ..... 405/262, 259; 411/8-12; 116/DIG. 34

[56] References Cited

U.S. PATENT DOCUMENTS

| | | | |
|---|---|---|---|
| 2,725,843 | 12/1955 | Koski . | |
| 2,738,754 | 3/1956 | Bierer . | |
| 3,174,386 | 3/1965 | Lewis | 411/10 |
| 3,179,082 | 4/1965 | McClean . | |
| 3,967,455 | 7/1976 | Conway . | |
| 4,112,693 | 9/1978 | Collin et al. . | |
| 4,149,446 | 4/1974 | Spengler et al. | 411/11 |
| 4,322,193 | 3/1982 | Stahl | 411/11 |
| 4,334,803 | 6/1982 | Westlake et al. | 405/259 |
| 4,410,296 | 10/1983 | Unrug | 405/259 |

FOREIGN PATENT DOCUMENTS

| | | | |
|---|---|---|---|
| 122917 | 9/1980 | Japan | 405/259 |

*Primary Examiner*—Peter M. Cuomo

*Attorney, Agent, or Firm*—James W. Grace

[57] ABSTRACT

This invention relates to a rib bolt assembly including a collapsible yield device located between an exposed end of the rib bolt and a side of a mine pillar in which the collapsible yield device will withstand a predetermined torque but will collapse at a stress less than the failure strength of the rib bolt.

4 Claims, 1 Drawing Sheet

YIELD TUBE BOLT ASSEMBLY

This is a continuation of Ser. No. 741,995, filed June 6, 1985, now abandoned.

BACKGROUND OF THE INVENTION

1. Field of the Invention

This invention is useful in the underground mining of minerals and particularly, the mining of coal. While the invention is especially applicable in coal mining operations, and will be described in that environment, the scope of the invention should not be limited to that type of operation.

2. Description of the Invention

Generally, in a coal mining operation, coal is removed from the face of a coal seam and deposited onto a flexible conveyor for removal from the mine.

Throughout the mine there are passageways which permit miners to move around through the mine. These passageways are separated by pillars which are areas of the mine that have not been mined. As these pillars have exposed faces, the vertical forces on the pillars cause the pillars to expand into the passageways. If the expansion is severe, the pillar side may collapse into the passageways.

In order to keep the pillar side from collapsing, angled rib bolts are used to support the exposed sides of the pillars in the mine. These bolts are inserted into long holes drilled into the face of the pillar, usually at a 45° angle with respect to the face of the pillar. The bolts are held in place by an expansion shell or set resin in which one end of the bolt is anchored.

In the past, a crescent washer at the head or exposed end of the bolt held a header or bearing plate against the face of the pillar to inhibit expansion of the pillar side and prevent its collapse. One of the problems which occurred in the prior art structure was the breakage of the rib bolt when the stress of the expanding pillar exceeded the failure strength of the rib bolt.

SUMMARY OF THE INVENTION

In accordance with the present invention, a yield device is placed between the hardened washer at the exposed end of the bolt and the header or bearing plate. The yield device permits the pillar to expand outwardly and keeps a constant tension on the bolt. However, because the yield device gradually collapses or splits in a controlled manner, the angle rib bolts do not abruptly break. Once the yield device is destroyed, the bolt head with its hardened washer acts against the bearing plate and the bolt then acts as a standard rib bolt undergoing load elongation.

The yield device should also allow the pillar to temporarily destress itself while maintaining rib bolt control. This should further increase rib bolt longevity and especially prevent rib bolt failures in coal face work areas.

SUMMARY OF THE INVENTION

The invention relates to a simple device which inhibits rib bolt breakage and controls horizontal expansion of pillars in coal mines.

It is an object of the invention to provide a novel device for controlling the expansion of pillars in coal mines and reduce rib bolt failures.

It is another object of the invention to provide a novel device for controlling the expansion of pillars in coal mines in a simple, yet effective manner.

Other objects and advantages of the present invention will become apparent to those skilled in the art from a consideration of the attached drawing in which like numerals indicate like elements and in which.

Figure 1:
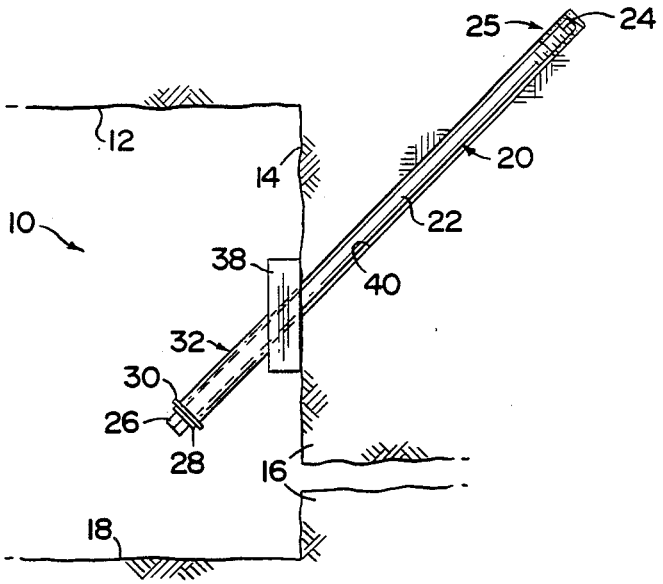
FIG. 1 is a cross-sectional elevational view of a portion of a coal mine with the novel device of the invention installed.
Figure 2:
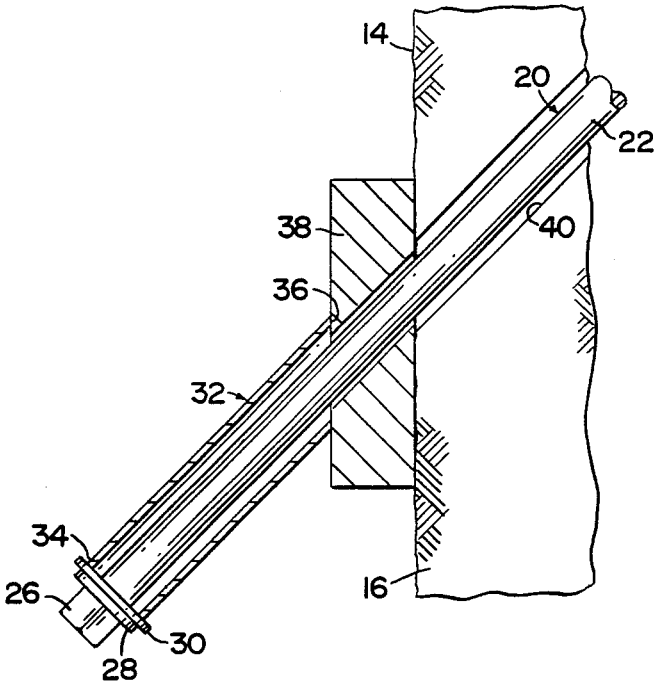
FIG. 2 is an expanded view of a portion of FIG. 1 showing the novel device of the invention in greater detail.

Referring now to FIGS. 1 and 2, there is therein shown a cross-section of a coal mine with a passageway 10 running under a roof 12 which may be a strata of coal or overburden. Along one side of passageway 10 is a seam face 14 which is the edge of a strata of coal or rock which forms pillar 16. Passageway 10 has a floor 18. Passageway 10 is made by mining out the minerals in the seam.

In order to prevent outward collapse of pillar 16, an angled rib bolt 20 is used to secure a bearing plate against face 14 of pillar 16.

Rib bolt 20 may be a conventional bolt used in mining operations as a roof bolt and consists of a shank 22 which is threaded at end 24 for engagement with a bolt expansion shell anchor unit 25. Expansion shell anchor unit 25 may be of the type sold commercially by the Birmingham Bolt Company of Ensley, Ala.

Rib bolt 20 may be an elongated ¾ inch diameter rod of grade 55 steel which will break or fail when a stress of about 30,000 pounds is applied to it. Of course, other rib bolts of different diameter and material may be used, each having a maximum load bearing capacity before failure. The maximum load before failure may range from 20,000 pounds to 30,000 pounds or more depending upon the diameter and material of the rib bolt.

The shank 22 of the present rib bolt may be made of steel, fiberglass, wood, and the bolt head of steel, fiberglass, or cast iron.

Bolt head 26 includes a main body portion which is of nutlike configuration, one end of which is enlarged to provide a peripheral flange 28 which is uniplanar with a body terminal.

A washer 30 may be placed over shank 22 of rib bolt 20 and rests against peripheral flange 28 of bolt head 26.

A collapsible yield device 32 is placed over shank 22 of rib bolt 20 and rests against washer 30 or flange 28. Collapsible yield device 32 may be a hollow steel tube of 14 to 16 gauge. End 34 of tube 32 rests against washer 30 or flange 28. End 34 of yield device or tube 32 is cut at right angles to the longitudinal axis of tube 32 so that its end 34 fits snuggly against washer 30 or flange 28. The other end 36 of tube 30 is cut at an angle of about 45° (equal to the acute angle which rib bolt 20 makes with face 14 of pillar 16).

A bearing plate 38, having a central hole, is placed over shank 22 of rib bolt 20 to rest against end 36 of tube 32. Bearing plate 38 may be of variable thickness and dimension (6 inches in width by 16 inches in length is common). Angle rib bolt 20 is inserted in a hole 40 (see FIG. 2) drilled in a conventional way into pillar 16 at an angle of about 45° with respect to the vertical face 14 of pillar 16. To hold the upper end of rib bolt 20 securely in place, an expansion shell anchor or set resin is used at the upper end of hole 40. After hole 40 has been drilled in pillar 16, rib bolt 20 with an expansion shell anchor is then pushed up until the bearing plate 38 is in position against the pillar face 14. Rib bolt 20 is then rotated. During the rotation of rib bolt 20, the expansion anchor sets, rib bolt 20 is tightened upwardly in hole 40 until bearing plate 38 fits snuggly against face 14. After the bolt is tightened, rib bolt 20 holds bearing plate 38 tightly against face 14 while yield device or tube 32 is held tightly against bearing plate 38 by the compression effect of washer 30 and bolt head 26.

The rotation of rib bolt 20 is accomplished by a mechanically driven socket which applies a torque which generates a minimum bolt load of about 2500 pounds.

Figure 3:
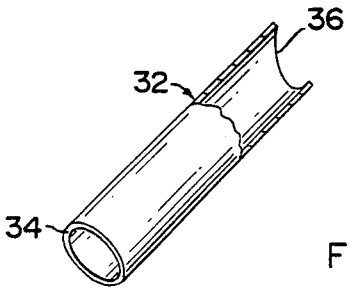
FIG. 3 is a perspective view, partially in cross-section, of the novel device of the invention.

FIG. 3 shows collapsible yield device 32 in greater detail. Collapsible yield device 32 is a hollow, round tube of steel or other high tensile strength material with an outside diameter of approximately 1⅝" and of variable length (6 inches may be used). The outside diameter need only be less than the diameter of washer 30 or bolt flange 28 which may be 2-inches in diameter. Washer 30 or bolt flange 28 is of hardened steel, so that tube 32 can collapse or split between its ends 34 and 36 when sufficient stress is placed on tube 32 as it is being compressed between washer 30 and bearing plate 38. The inner diameter of tube 32 need only be large enough to accommodate the shank 22 of rib bolt 20 which may be ¾ inch in outer diameter. Tube 32 may be of 14 to 16 gauge in thickness. The strength of tube 32 is determined by its thickness and the nature of the material of which it is made. The strength of tube 32 should be such that tube 32 will not collapse when the setting torque is applied to bolt head 26, but tube 32 will collapse at a load below the failure strength of the rib bolt. For example, for a rib bolt of ¾ inch in diameter of grade 55 steel, tube 32 should not collapse at a load of 2,500 pounds, but will collapse or split at a load below 30,000 pounds.

After the assembly of the rib bolt 20, the bolt head 26, the washer 30, the yield device 32 and bearing plate 38 has been secured in place, the system will provide support for pillar 16. Of course, a system of such rib bolt assemblies will be used in an actual mine setting. Generally, such rib bolt assemblies are installed on approximately 4-ft. centers.

In an actual installation in which rib bolt assemblies with and without yield devices were compared, it was found that as the pillar expanded, the yield tubes began to split or crush prior to the breaking of all the rib bolts which did not have yield tubes. As the pillar further expanded beyond the point where all of the rib bolts without yield tubes were broken, 50 percent of the yield tubes deformed to where the washer rested against the bearing plate. At this point, no rib bolts of those assemblies with yield tubes failed. Even as the pillar further expanded up to the point where 80 percent of the yield tubes were deformed so that the washer was resting against the bearing plate, none of the rib bolts of this assembly broke.

While the present invention has been illustrated and described in connection with a conventional expansion shell anchor type bolt assembly, it is to be understood that it may also be employed with a resin type rib bolt or roof bolt by making appropriate changes to the various elements of the invention.

Various other changes may be made within the scope of the appended claims.

I claim:

1. In a mine in which an elongated rib bolt is fixed at one end in a receiving hole in a mine wall and said rib bolt has an exposed portion extending outwardly beyond the face of said mine wall and terminating in an exposed end, said rib bolt having a predetermined failure strength, the combination comprising a bearing plate mounted on said rib bolt portion and resting against said mine wall, a collapsible cylindrical metal tube encompassing said rib bolt mounted on said exposed portion between said bearing plate and said exposed end, and means mounted on said exposed end for tightly compressing said cylindrical metal tube and said bearing plate together and forcing said bearing plate tightly against said face of said mine with a predetermined torque, said cylindrical metal tube being capable of withstanding said predetermined torque but being gradually, longitudinally collapsible in response to an applied force greater than said predetermined torque but lower than said predetermined failure strength of said rib bolt, whereby said mine wall expands outwardly while said cylindrical metal tube keeps constant tension on said rib bolt.

2. The combination as recited in claim 1 in which said predetermined torque generates a minimum load of about 2,500 pounds and said failure strength of said rib bolt is about 30,000 pounds.

3. The combination as recited in claim 1 in which said cylindrical metal tube will not collapse under a longitudinal compressive load of about 2,500 pounds but will collapse under a compressive load of less than about 30,000 pounds.

4. The combination as recited in claim 1 in which said rib bolt is fixed in a receiving hole in a mine wall, which receiving hole is directed at an acute angle with respect to said face of said mine wall and said cylindrical metal tube has one end perpendicular to the longitudinal axis of said cylindrical metal tube and having a distant end lying in a plane at an acute angle with respect to the longitudinal axis of said cylindrical metal tube, said acute angle of said receiving hole being equal to said acute angle of said distant end of said cylindrical tube.

* * * * *